US007769323B2

(12) United States Patent
Hart et al.

(10) Patent No.: US 7,769,323 B2
(45) Date of Patent: Aug. 3, 2010

(54) ACOUSTIC DAMPENING MATERIAL FOR IMAGING DRUM

(75) Inventors: Steven C. Hart, Webster, NY (US); Pat C. Campbell, Farmington, NY (US)

(73) Assignee: Xerox Corporation, Norwalk, CT (US)

( * ) Notice: Subject to any disclaimer, the term of this patent is extended or adjusted under 35 U.S.C. 154(b) by 95 days.

(21) Appl. No.: 11/708,974

(22) Filed: Feb. 21, 2007

(65) Prior Publication Data

US 2008/0199216 A1 Aug. 21, 2008

(51) Int. Cl.
*G03G 15/00* (2006.01)

(52) U.S. Cl. ..... 399/159

(58) Field of Classification Search ..... 399/159, 399/116

See application file for complete search history.

(56) References Cited

U.S. PATENT DOCUMENTS 4,415,639 A 11/1983 Horgan
5,153,618 A 10/1992 Frank et al.
5,420,664 A * 5/1995 Miwa et al. ..... 399/167
5,669,045 A 9/1997 Swain
5,686,215 A 11/1997 Bergfjord, Sr. et al.
5,722,016 A 2/1998 Godlove et al.
5,772,016 A * 6/1998 Akerlind ..... 206/221
5,960,236 A 9/1999 Zaman et al.
6,208,821 B1 * 3/2001 Grune et al. ..... 399/159
6,438,338 B1 8/2002 Mark et al.
6,782,224 B2 * 8/2004 Kim ..... 399/159
6,907,657 B2 6/2005 Wilbert et al.
7,155,143 B2 12/2006 Miner et al.
2003/0002885 A1 * 1/2003 Litman et al. ..... 399/159
2004/0042822 A1 * 3/2004 Fujishiro et al. ..... 399/159
2005/0042437 A1 * 2/2005 Ramesh et al. ..... 428/304.4

* cited by examiner

*Primary Examiner*—Quana M Grainger
(74) *Attorney, Agent, or Firm*—Pillsbury Winthrop Shaw Pittman LLP

(57) ABSTRACT

Method for acoustic dampening of photoreceptor and ionographic drums using an acoustic dampening applied to and cured on the interior of a drum. Embodiments provide excellent acoustic dampening of the resonance modes, and thus, substantially eliminates the problematic sounds that are often emitted from the xerographic printing machines.

7 Claims, 2 Drawing Sheets

ACOUSTIC DAMPENING MATERIAL FOR IMAGING DRUM

BACKGROUND

Herein disclosed are embodiments generally relating to electrostatographic imaging members and assemblies comprising electrostatographic imaging members and acoustic dampening means. The acoustic dampening means provide excellent acoustic dampening of the resonance modes of imaging drums. More specifically, the embodiments disclose an acoustic dampening material employed in photoreceptor and/or dielectric receptor drums to substantially eliminate acoustic noise generated by drum image receivers in electrostatographic printing machines.

The term electrostatographic is used to generally encompass the fields of electrophotography and/or ionography. Hereafter, the term "drum" and/or "electrostatographic drum" will refer to either type of imaging drum—i.e. both photoreceptor and ionographic imaging drums. Electrostatographic imaging members are well known in the art. The imaging members may be in the form of various configurations such as a flexible web type belt or cylindrical drum. The drums comprise a hollow cylindrical substrate and at least one electrostatographic coating. These drums are usually supported by a hub held in place at the end of each drum. The hub usually includes a flange extending into the interior of the drum. This flange is usually retained in place by an interference fit and/or an adhesive. An axle shaft through a hole in the center of each hub supports the hub and drum assembly. Electrostatographic imaging members may be electrophotographic members or electrographic (ionographic) members. It is well known that electrophotographic members comprise at least one photosensitive imaging layer and are imaged with the aid of activating radiation in image configuration. Similarly, electrographic imaging members comprise at least one dielectric layer upon which an electrostatic latent image is formed directly on the imaging surface by shaped electrodes, ion streams, styli and the like.

A typical electrostatographic imaging process cycle involves forming an electrostatic latent image on the imaging surface, developing the electrostatic latent image to form a toner image, transferring the toner image to a receiving member and cleaning the imaging surface. Cleaning of the imaging surface of electrostatographic imaging members is often accomplished with a doctor type resilient cleaning blade that is rubbed against the imaging surface of the imaging members.

When electrostatographic imaging members are cleaned by doctor type cleaning blades rubbing against the imaging surface to remove residual toner particles remaining on the imaging surface after toner image transfer to a receiving member, a high pitched ringing, squealing, squeaking, or howling sound can be created which is so intense that it is intolerable for machine operators. This is especially noted in drum type imaging members comprising a hollow cylindrical substrate. The sound apparently is caused by a "stick-slip" cycling phenomenon during which the cleaning blade initially "sticks" to the imaging surface and is carried in a downstream direction by the moving imaging surface to a point where resilience of the imaging blade forces the tucked blade to slip and slide back upstream where it again sticks to the photoreceptor and is carried downstream with the imaging surface until blade resilience again causes the blade to flip back to its original position. The upstream flipping motion kicks residual toner particles forward. The stick-slip phenomenon is somewhat analogous to the use of a push broom for cleaning floors where the push broom is most effective for cleaning when it is pushed a short distance and then tapped on the floor with the cycle being repeated again and again. This stick-slip phenomenon is important for effective removal of residual untransferred toner particles from an imaging surface and for prevention of undesirable toner film or toner comets from forming on the imaging surface during cleaning.

An adhesive relationship between the cleaning blade and the imaging member surface appears to contribute to the creation of the howling sound. More specifically, the stick-slip effect occurs where there is a strong adhesive interaction between the cleaning blade and the imaging surface. The howling sound appears to be caused by resonant vibration of the drum induced by the stick-slip phenomenon. Other factors contributing to creation of the screaming or howling sound may include factors such as the construction of the imaging member, the blade contacting the imaging member, the type of blade holder construction, and the like. For example, a flimsy blade holder can contribute to the howling effect. Moreover, a thinner, shorter, stubbier cleaning blade tends to contribute the howling effect. Thin imaging member drums can also lead to the howling effect. The stick-slip phenomenon also depends on the lubricating effect of toner and/or carrier materials utilized. Moreover, ambient temperatures can contribute to the creation of howling. It appears that resonance is initiated at the point of contact between the cleaning blade and the imaging member. The creation of the screaming or howling sound might be analogous to rubbing a fingertip around the edge of a wine glass. The screaming or howling noise phenomenon is especially noticeable for cylindrical photoreceptors having a hollow metal or plastic drum shaped substrate. Generally, where the imaging member is the cause of a howling sound, it will emit a ringing sound when tapped.

Some methods use to reduce the noise include adding lubricants to the toner to reduce the frictional excitation (chatter or slip stick motion), which in turn reduces the excitation energy driving the acoustic resonance, internal "silencers" of various materials and configurations inserted into the interior cavity of the photoreceptor drum to absorb the sound energy and reduce the resonance amplitude, and increasing the wall thickness of the photoreceptor drum, which in turn increases the stiffness of the drum to raise resonant frequency and reduce amplitude of vibration for any given level of excitation. For example, U.S. Pat. Nos. 7,155,143, 6,438,338, 5,669,045 and 5,960,236, which are herein incorporated by reference in their entirety, disclose internal "silencers." However, these known methods suffer from drawbacks, such as poor fit in the drum, poor sound absorption and relatively high cost.

Thus, there is a continuing need for improved systems and apparatuses which substantially reduce acoustic resonance and thus substantially eliminate acoustic noise caused by drum photoreceptors in xerographic printing machines.

SUMMARY

According to embodiments illustrated herein, there is provided an electrostatographic imaging member assembly that includes acoustic dampening means that provide excellent acoustic dampening of the resonance modes of electrostatographic drums, and thus, substantially eliminate acoustic noise caused by electrostatographic drums.

In particular, an embodiment provides an electrostatographic drum comprising a hollow cylindrical substrate, at least one imaging layer disposed on the hollow cylindrical substrate, and an acoustic dampening material at least partially applied to an interior surface of the hollow cylindrical substrate such that intimate contact is made between the acoustic dampening material and the interior surface of the hollow cylindrical substrate.

Embodiments also provide an electrostatographic imaging member assembly comprising an electrostatographic drum, wherein the electrostatographic drum further comprises a hollow cylindrical substrate, at least one imaging layer disposed on the hollow cylindrical substrate, and an acoustic dampening material at least partially applied to an interior surface of the hollow cylindrical substrate such that intimate contact is made between the acoustic dampening material and the interior surface of the hollow cylindrical substrate, and a cleaning blade assembly, wherein the cleaning blade assembly further comprises a cleaning blade, and a blade holder adapted to support the cleaning blade.

Further embodiments provide a method for dampening acoustic resonance in an electrostatographic drum, comprising applying an acoustic dampening material to an electrostatographic drum, wherein the electrostatographic drum comprises a hollow cylindrical substrate, and at least one imaging layer, and wherein the acoustic dampening material is at least partially applied to an interior surface of the hollow cylindrical substrate, and curing the acoustic dampening material so that intimate contact is made between the acoustic dampening material and the interior surface of the hollow cylindrical substrate.

BRIEF DESCRIPTION OF THE DRAWINGS

For a better understanding of the present invention, reference may be had to the accompanying figures.

DETAILED DESCRIPTION

Figure 1:
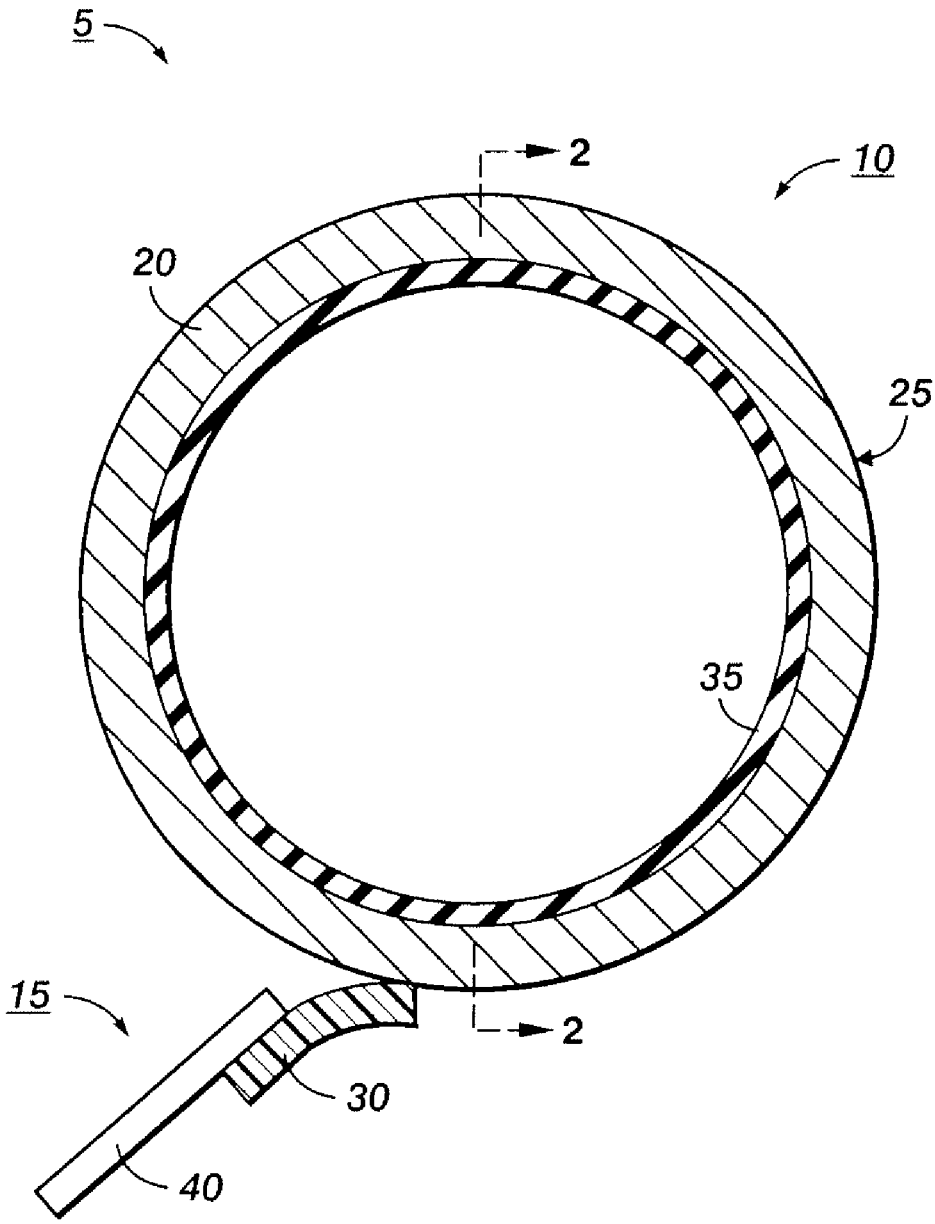
FIG. 1 is a cutaway perspective view of an electrostatographic drum according to an embodiment of the present disclosure.

In the following description, it is understood that other embodiments may be utilized and structural and operational changes may be made without departure from the scope of the present embodiments disclosed herein.

The present embodiments relate to the use of an acoustic dampening compound partially applied to and cured on the interior of an electrostatographic drum. The applied material provides excellent acoustic dampening of the resonance modes, and thus, substantially eliminates the problematic sounds that are often emitted from the xerographic printing machines. The acoustic dampening compound can, in embodiments, be a latex caulk or room temperature vulcanizing silicon rubber (RTV), and can be applied as a layer or bead of the acoustic dampening compound. When cured, the material is in intimate contact with the inside of the drum and remains flexible. Intimate is defined herein as conforming to microscopic variations in the interior surface and providing a contact area of at least 90% or greater of the total interface surface. This method is a simple yet effective way to provide excellent acoustic dampening of the resonance modes and silencing the xerographic printing machines.

Xerographic printers employing rigid electrostatographic drums often exhibit acoustic noise. This noise occurs because of the excitation of an acoustic resonant mode of the electrostatographic drum by the slip-stick motion of the cleaning blade. The resultant sounds have been classified by a variety of names describing the sounds to which they have resemblance, for example, "mooing", "grunting", "squealing", and the like. Common approaches have encountered drawbacks of their own, such as poor fit in the drum, poor sound absorption and relatively high cost.

The present embodiments disclose a method of application of an acoustic dampening material to the inside of the electrostatographic drum. Specifically, a bead or layer of an acoustic dampening compound, such as RTV type silicone or latex caulk, is applied partially to the inside of the drum and allowed to cure. In addition, any other flexible material similar to RTV type silicone or latex caulk can be used with the present embodiments. Once cured, the acoustic dampening material is in intimate contact with the inside of the drum and remains flexible, which provides excellent acoustic dampening of the various resonance modes or sounds. The intimate contact ensures that the acoustic dampening material fits well along the interior of the drum and thoroughly covers all areas that would emit the various resonance modes.

In comparison, previous "silencers" or "silencer inserts," for example, plastic slugs with C-shaped cross-sections and about 4 inches long) employed for the same purpose did not work well since the "silencers" did not make good intimate contact with the electrostatographic drum and were fairly rigid (hence not acoustically "lossy"). Because sound propagates well through hard rigid materials such as aluminum as well as through non-viscous liquids such as water, the selected acoustic dampening material needs to be flexible or, if a liquid, needs to be viscous or "sticky." Materials such as peanut butter, JELL-O, mayonnaise, RTV type silicone, and latex caulk are examples of lossy materials. Furthermore, the "silencers" are significantly more expensive than a bead or thin layer of RTV type silicone or caulk. For example, some silencers cost on the order of $0.20 each, and two or more are needed for each electrostatographic drum. It is estimated that about 20 grams or less of the acoustic dampening compound, for example, RTV type silicone, would be needed to perform the desired dampening function. As such, the present embodiments, using the acoustic dampening compound, is estimated to cost about $0.10 per drum. Thus, the present embodiments have shown to be more effective in dampening resonance modes of the electrostatographic drum as well as more cost-effective than previous methods.

The dampening material needs to make very intimate contact so as to allow the sound waves to propagate into the lossy material. Compounds such as RTV type silicone, latex caulk, or high temperature vulcanizing silicone rubber (used in fuser rolls) make excellent contact and even chemically bond to the electrostatographic drum interior surface. This property provides excellent acoustic coupling between the drum substrate and the dampening material. In addition, the compounds used in the present embodiments are compatible with the imaging member material coating so as to not outgas or degrade the imaging member performance.

Figure 2:
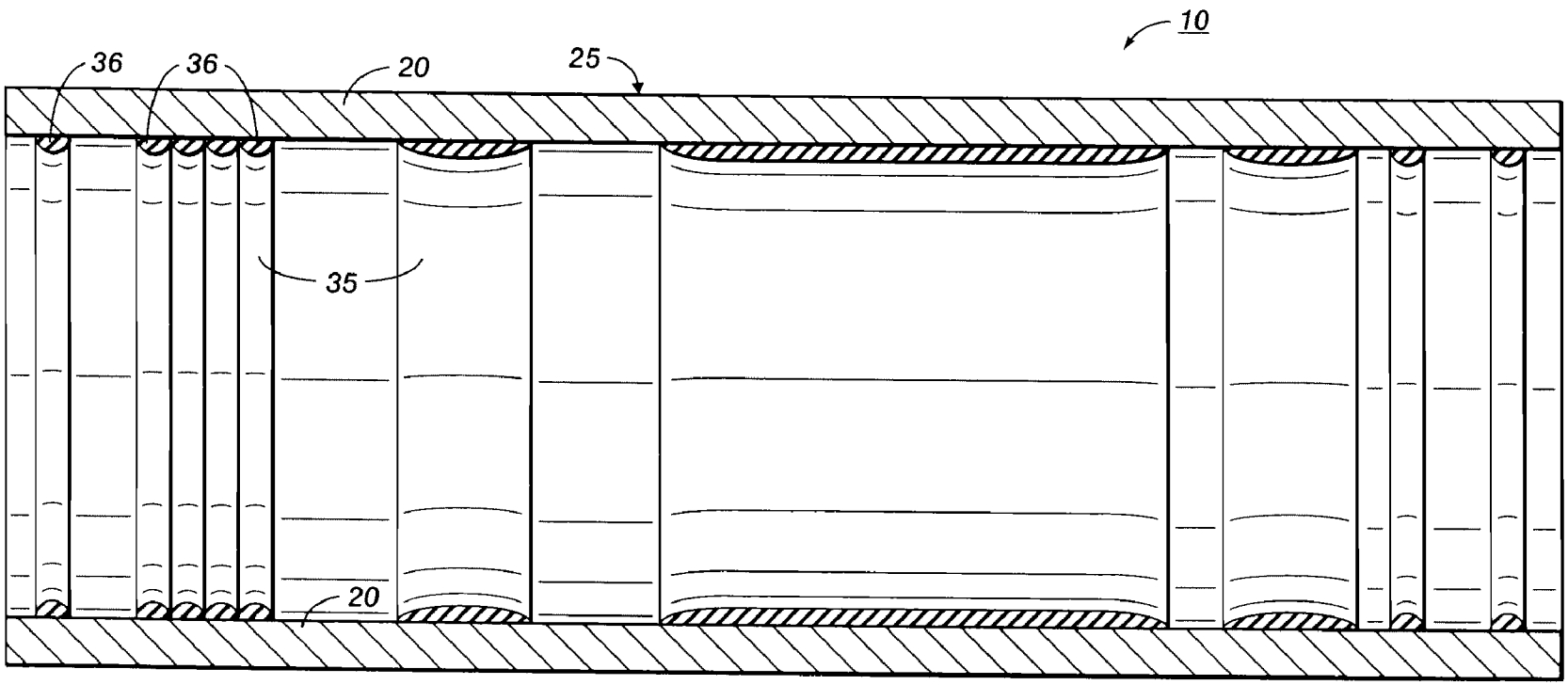
FIG. 2 is an alternative cutaway perspective view of an electrostatographic drum according to another embodiment of the present disclosure.

In embodiments, there is provided an electrostatographic drum that performs without causing the undesired noises often emitted by the xerographic printing machines. As shown in FIG. 1, an electrostatographic imaging member assembly 5 is illustrated as comprising a hollow electrostatographic imaging drum 10 and a cleaning blade assembly 15. The imaging drum 10 further comprises a hollow cylindrical substrate 20 and at least one electrophotographic imaging layer 25. The cylindrical substrate 20 may comprise any suitable material such as aluminum, nickel, non magnetic stainless steel, copper, metallic alloys of these materials, and plastic materials both of the thermo set and thermoplastic type and both with and without reinforcement such as carbon fiber (graphite), fiberglass, glass bead, etc , mixtures thereof, and the like. In FIG. 1, the cleaning blade assembly 15 is in contact with the outer imaging surface of the electrophotographic imaging layer 25. The cleaning blade assembly 15 comprises a resilient elastomeric cleaning blade 30 supported by a relatively rigid blade holder 40. The cleaning blade holder 40 may be supported in any suitable manner, such as for example, a machine housing (not shown) which also provides support for the imaging drum 10. Along the interior of the imaging drum 10, in intimate contact with the inner side of the hollow cylindrical substrate 20, is a layer of an acoustic dampening compound 35. In other embodiments, as shown in FIG. 2, the acoustic dampening compound may be in the form of one or more beads 36. This compound may be RTV type silicone, latex caulk, High Temperature Vulcanizing Silicone rubber, or any similar flexible material, or mixtures thereof.

In embodiments, the layer of acoustic dampening compound 35 has a thickness of from about 0.1 mm to about 6.0 mm. In other embodiments, the thickness is from about 0.5 mm to about 3.0 mm. In embodiments, the layer may have a length of from about 10 mm to about the entire length of the interior surface of the hollow cylindrical substrate. In further embodiments, the length of the layer may be extended to within about 5 mm of the end of the drum 10 on either end. In yet further embodiments, one or more beads, two or more beads, or multiple beads may be used to provide acoustic dampening 36. Where multiple beads of the acoustic dampening material 36 are used, the beads are applied to the interior surface of the hollow cylindrical substrate. In a particular embodiment, the multiple beads are applied to the interior surface of the hollow cylindrical substrate with each bead being applied about 100 mm in from each end of the hollow cylindrical substrate and optionally with one bead being applied to approximately a center of the hollow cylindrical substrate.

Cleaning blades are conventional and well known in the art. Any suitable cleaning blade and cleaning blade holder may be used with the electrostatographic imaging member assembly 5 of this invention. In operation, the electrostatographic imaging member 5 is rotated in the direction shown by the arrow so that the cleaning blade assembly 15 rubs across the outer imaging surface of layer 25 in a "doctor" or chiseling attitude. The stick-slip interaction between the cleaning blade 30 and the imaging surface of imaging layer 25 can cause howling sounds to occur when electrostatographic imaging drum 10 does not contain the layer 35 or bead 36 of acoustic dampening compound. The acoustic dampening layer 35, as illustrated in FIG. 1, generally is applied and cured over a portion of the interior of hollow cylindrical substrate 20. The acoustic dampening compound used for the dampening layer 35 is in intimate contact with the interior surface of the hollow cylindrical substrate 20 such that the intimate contact ensures reduction or elimination of the squealing or howling sounds that can occur when the cleaning blade 30 contacts the outer imaging surface 25 of the electrostatographic imaging drum 10, and prevents relative movement between the acoustic dampening layer 35 and the hollow cylindrical substrate 20.

In further embodiments, there is provided a method for dampening acoustic resonance in electrostatographic drums that comprises applying an acoustic dampening material to an electrostatographic drum. The electrostatographic drum may comprise a hollow cylindrical substrate, and at least one imaging layer. The acoustic dampening material is at least partially applied to an interior surface of the hollow cylindrical substrate. After applying the acoustic dampening material, the material is cured so that intimate contact is made between the acoustic dampening material and the interior surface of the hollow cylindrical substrate. In embodiments, the acoustic dampening material can be applied in the form of a layer 35 or in the form of one or more beads 36, and generally, only 20 grams or less of the acoustic dampening material is sufficient for use. However, in alternative embodiments, from about 5 grams to about 400 grams of the acoustic dampening material may be used. The acoustic dampening material may be, in embodiments, room temperature vulcanizing silicon rubber, high temperature vulcanizing silicone rubber, latex caulk, or mixtures thereof.

Because electrostatographic drums require machining prior to coating, the optimal time and/or location in the fabrication process to apply the dampening compound is after counter-boring the end hubs (if necessary) and potentially to diamond turning the surface. Internal dampeners have been show to be beneficial during the diamond turning step, as disclosed in U.S. Pat. No. 6,907,657, which is herein incorporated by reference in its entirety.

The acoustic dampening compound can be easily applied after finishing the second (final) counter-bore while the drum blank is still in the lathe. At this point, a dispensing probe with a right angle tip can be inserted into the drum interior to dispense the acoustic dampening compound material. The probe may be mounted parallel to the lathe cylindrical axis, and not co-linear to it. In this configuration, the probe is capable of rotating on its long axis, and capable of traversing down the lathe bed long axis (Z axis). This mounting arrangement would allow the probe to be inserted with the dispensing tip rotated away from the interior surface, and with the tip rotated into dispensing position, the probe can dispense the acoustic dampening compound (much like flow coating a fuser roll). Thereafter, the tip is rotated into the retraction position, and finally retracted from the drum interior.

Generally, the electrostatographic imaging member may comprise an electrophotographic imaging member. Electrophotographic imaging members and electrographic imaging members are well known in the art and may be of any suitable configuration such as, for example, a flexible belt or a hollow cylinder, which is addressed by the embodiments described herein. Electrostatographic imaging members usually comprise a supporting substrate having an electrically conductive surface. Electrophotographic imaging members also comprise at least one photoconductive layer. A blocking layer may optionally be positioned between the substrate and the photoconductive layer. If desired, an adhesive layer may optionally be utilized between the blocking layer and the photoconductive layer. For multilayered imaging members, a charge generation layer is usually applied onto the blocking layer and a charge transport layer is subsequently formed over the charge generation layer. For electrographic imaging members, an electrically insulating dielectric layer is applied directly onto the electrically conductive surface. Any suitable, conventional, electrically insulating dielectric polymer may be used in the dielectric layer of the electrographic imaging member. The specific details of the various layers of an imaging member have been described further in, for example, U.S. Pat. Nos. 4,415,639, 5,686,215 and 5,153,618, the disclosures thereof being incorporated herein in their entirety.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLE

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

An electrostatographic imaging member assembly was provided with a hollow electrostatographic drum and a cleaning blade assembly. The electrostatographic drum was of the XEROX Workcentre 55 family, and had a diameter of 84 mm. A thin layer of about 1 mm thick applied over a band or region of about 25 to about 75 mm near the middle of the interior side of the drum was sufficient to dampen acoustic resonance of the drum. This amount equates to between about 7 and about 20 grams of RTV type silicone on the Xerox Workcentre Pro 55 family drum(s). It has been shown from the testing that the more acoustic dampening compound material that is applied to the electrostatographic drum, the better the dampening will be. While the layer may have a thickness of from about 0.1 mm to about 6.0 mm, the data suggests that the dampening ability is more effective at the higher thicknesses.

Example 2

An electrostatographic imaging member assembly was provided with a hollow electrostatographic drum and a cleaning blade assembly. Two beads of RTV type silicone rubber were applied to the interior of an unflanged drum at two locations, each about 100 mm in from each end and approximately 10 grams of material in each bead. The drum was then mounted in a suitable clamp designed so as not to damp the resonance. When properly mounted and tapped with a wood stick, an undamped drum sounds much like a like a chime. On the other hand, the drum with the beads of RTV type silicone rubbers produced a dull thunk. Audio recordings of the sound clearly show that the acoustic resonance is quickly damped in the inventive drum having the beads of acoustic dampening compound. Based on the preliminary testing, it appears that a well-damped drum will not exhibit any of the undesirable sounds when operated in a suitable machine environment.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An electrostatographic drum comprising:

a hollow cylindrical substrate;

at least one imaging layer disposed on the hollow cylindrical substrate; and an acoustic dampening material at least partially applied to an interior surface of the hollow cylindrical substrate and cured on the interior surface of the hollow cylindrical substrate in the form of one or more beads such that intimate contact is made between the cured acoustic dampening material and the interior surface of the hollow cylindrical substrate, and wherein the acoustic dampening material is selected from the group consisting of room temperature vulcanizing silicon rubber, high temperature vulcanizing silicone rubber, latex caulk, and mixtures thereof and the amount of acoustic dampening material used is no more than about 20 grams.

2. The electrostatographic drum of claim 1, wherein multiple beads of the acoustic dampening material are applied to the interior surface of the hollow cylindrical substrate.

3. An electrostatographic drum comprising:

a hollow cylindrical substrate;

at least one imaging layer disposed on the hollow cylindrical substrate; and an acoustic dampening material at least partially applied to an interior surface of the hollow cylindrical substrate and cured on the interior surface of the hollow cylindrical substrate in the form of multiple beads such that intimate contact is made between the cured acoustic dampening material and the interior surface of the hollow cylindrical substrate, and wherein the acoustic dampening material is selected from the group consisting of room temperature vulcanizing silicon rubber, high temperature vulcanizing silicone rubber, latex caulk, and mixtures thereof, the amount of acoustic dampening material used is no more than about 20 grams, and the multiple beads are applied to the interior surface of the hollow cylindrical substrate with each bead being applied about 100 mm in from each end of the hollow cylindrical substrate and optionally with one bead being applied to approximately a center of the hollow cylindrical substrate.

4. An electrostatographic imaging member assembly comprising:

an electrostatographic drum, wherein the electrostatographic drum further comprises a hollow cylindrical substrate, at least one imaging layer disposed on the hollow cylindrical substrate, and an acoustic dampening material at least partially applied to an interior surface of the hollow cylindrical substrate and cured on the interior surface of the hollow cylindrical substrate in the form of one or more beads such that intimate contact is made between the cured acoustic dampening material and the interior surface of the hollow cylindrical substrate, wherein the acoustic dampening material is selected from the group consisting of room temperature vulcanizing silicon rubber, high temperature vulcanizing silicone rubber, latex caulk, and mixtures thereof and the amount of acoustic dampening material used is no more than about 20 grams; and a cleaning blade assembly, wherein the cleaning blade assembly further comprises a cleaning blade, and a blade holder adapted to support the cleaning blade.

5. A method for dampening acoustic resonance in an electrostatographic drum, comprising:

applying an acoustic dampening material to an electrostatographic drum, wherein the electrostatographic drum comprises a hollow cylindrical substrate, and at least one imaging layer, and wherein the acoustic dampening material is at least partially applied to an interior surface of the hollow cylindrical substrate and cured on the interior surface of the hollow cylindrical substrate in the form of one or more beads, wherein the acoustic dampening material is selected from the group consisting of room temperature vulcanizing silicon rubber, high temperature vulcanizing silicone rubber, latex caulk, and mixtures thereof and the amount of acoustic dampening material used is no more than about 20 grams; and curing the acoustic dampening material so that intimate contact is made between the cured acoustic dampening material and the interior surface of the hollow cylindrical substrate.

6. The method of claim 5, wherein multiple beads of the acoustic dampening material are applied to the interior surface of the hollow cylindrical substrate.

7. The method of claim 6, wherein multiple beads of the acoustic dampening material is are applied to the interior surface of the hollow cylindrical substrate with each bead being applied about 100 mm in from each end of the hollow cylindrical substrate.

* * * * *